United States Patent [19]

Sakojiri et al.

[11] Patent Number: 4,916,042

[45] Date of Patent: Apr. 10, 1990

[54] MULTICOLOR IMAGING MATERIAL

[75] Inventors: Hiromichi Sakojiri; Hiroshi Takahashi, both of Tokyo, Japan

[73] Assignee: Seiko Instruments Inc., Japan

[21] Appl. No.: 104,348

[22] Filed: Oct. 2, 1987

[30] Foreign Application Priority Data

Jun. 22, 1987 [JP] Japan ..... 62-155224

[51] Int. Cl.[4] ..... G03C 1/54; G03C 1/72; G03C 7/00

[52] U.S. Cl. ..... 430/138; 430/173; 430/174

[58] Field of Search ..... 430/138, 173, 174

[56] References Cited

U.S. PATENT DOCUMENTS

| | | | |
|---|---|---|---|
| 3,301,439 | 1/1967 | Kosar et al. | 250/472.1 |
| 4,501,809 | 2/1985 | Hiraishi et al. | 430/211 |
| 4,529,992 | 7/1985 | Ishida et al. | 430/945 |
| 4,576,891 | 3/1986 | Adair et al. | 430/138 |
| 4,644,376 | 2/1987 | Usami et al. | 430/138 |
| 4,758,495 | 7/1988 | Yamaguchi et al. | 430/138 |
| 4,760,048 | 7/1988 | Kurihara et al. | 430/138 |
| 4,816,367 | 3/1989 | Sakojiri et al. | 430/944 |

*Primary Examiner*—Paul R. Michl
*Assistant Examiner*—Thorl Chea
*Attorney, Agent, or Firm*—Bruce L. Adams; Van C. Wilks

[57] ABSTRACT

A multicolor imaging material comprises a substrate and a photosensitive layer comprising a heat-meltable microcapsule layer. The heat-meltable microcapsule has a capsule wall including an infrared absorbent and a coupling component as core material.

The photosensitive layer comprises a heat-meltable microcapsule layer and a color forming layer comprising a diazonium compound and a basic substance. The color forming layer is formed between the substrate and the heat-meltable microcapsule layer.

14 Claims, 2 Drawing Sheets

MULTICOLOR IMAGING MATERIAL

BACKGROUND OF THE INVENTION (1) Field of the Invention

The present invention relates to an imaging material and more particularly, to a diazo imaging material for imaging multicolor images utilizing a plurality of infrared rays having different wavelengths.

(2) Description of the Prior Art

Recording systems such as electron photography, electrostatic recording, current application recording, heat-sensitive recording, ink jet, etc. have been hitherto known as those for forming multicolor images. Further, much research as been conducted to develop recording system utilizing microcapsules, and various systems such as a pressure sensitive recording system, a heat-sensitive recording system and so on have already been invented. A number of patents concerning such recording system are disclosed, for example, in U.S. Pat. Nos. 4,399,209, 4,440,846, 4,501,809, 4,621,040 and so on.

U.S. Pat. No. 4,399,209 is directed to a transfer imaging system which comprises a layer of microcapsules wherein a chromogenic material is encapsulated with a photosensitive composition. The photosensitive composition comprises a radiation-curable composition which upon exposure causes an increase in its viscosity thereby preventing diffusion of the chromogenic material upon rupture of the capsule. Upon rupture of the capsules, those capsules in which the radiation-curable material is not activated will release the chromogenic material which will transfer to a developer sheet and react with the developer material to form the image. Similar imaging systems, i.e., a so-called self-contained imaging sheet wherein the developer and the photosensitive encapsule are carried on a single substrate, is described in U.S. Pat. No. 4,440,846.

A color imaging system employing the aforementioned photosensitive composition encapsulated in pressurerupturable microcapsules is described in British Pat. No. 2113860.

British Pat. No. 2113860 discloses a photosensitive material useful in full color imaging comprising a support having on the surface thereof microcapsules which individually contain cyan, magenta and yellow color formers and photosensitive compositions having distinctly different sensitivities. A uniform mixture of the microcapsules is distributed over the surface of the support. Images are formed by separating the red, green and blue components of the image to be reproduced and translating these components into different wavelengths of actinic radiation to which the photosensitive compositions are distinctly sensitive. The photosensitive material is image-wise exposed to the translated radiation and thereafter it is subjected to a uniform rupturing force, such as pressure, which causes the microcapsules in the underexposed and unexposed areas to rupture and release the color formers. The color formers then react with a developer material which is contained on the same or a different support and produce a full color image.

In these conventional techniques, the ink jet method involves a problem of clotting and is not sufficiently reliable, the other recording methods require many complicated steps for recording the three primary colors repeatedly from a CRT, etc. In particular, since the conventional recording material using capsules coloration recording is carried out by reacting one coloring component incorporated in capsules with the other coloring component present outside the capsules through the rupture of capsule walls caused by applied pressure, a pressure roll which has a force of 200–400 pounds per linear inch to break the capsules is needed.

SUMMARY OF THE INVENTION

In order to solve such disadvantages, the present invention aims at providing a imaging material from which multicolor images can be obtained in a simple process at a high speed.

Therefore, an object of the present invention is to provide an imaging material which causes color formation utilizing a plurality of infrared rays having different wavelengths.

Another object of the present invention is to provide a diazo imaging material from which multicolor images can be obtained in a simple process at a high speed.

Another more particular object of the present invention is to provide a method for forming an image which is feasible without rupturing capsules by pressure application.

An imaging material in accordance with the present invention comprises a substrate having thereon a photosensitive layer comprising a diazo compound, a coupling component, a coloring assistant and an infrared absorbent. The coupling component is encapsulated in a heat-meltable microcapsule as core material. The microcapsules have a capsule wall containing the infrared absorbent. The microcapsules are composed of a microcapsule layer. The diazo compound and coloring assistant are present in either a color forming layer or as core material of microcapsules. The microcapsules of cyan, the microcapsules of magenta and the microcapsules of yellow contain infrared absorbent having a wavelength of $\lambda_1$, infrared absorbent having a wavelength of $\lambda_2$ and infrared absorbent having a wavelength of $\lambda_3$, respectively, at the respective capsule wall thereof.

Image forming by use of the imaging material according to the present invention can be done with the following method.

Upon exposure to infrared rays having wavelengths of $\lambda_1$, $\lambda_2$ and $\lambda_3$ in response to signals of the three primary colors from a CRT, etc., the microcapsules of cyan, magenta and yellow are heated, whereby the coupling components contained in the respective microcapsules are reacted with the diazonium compounds and the coloring assistant, and cyan color portion, magenta color portion and yellow color portion are thus recorded. Next, the imaging material is subjected to overall exposure ultraviolet rays, in order to decompose the diazo compound remaining in the non-image areas, whereby developed images can be fixed.

DESCRIPTION OF THE PREFERRED EMBODIMENTS

The imaging material according to the present invention comprises a substrate having thereon a photosensitive layer. The photosensitive layer comprises a layer of heat-meltable microcapsules including at least a coupling component and a infrared absorbent. For example, the heat-meltable microcapsules have either of the following two arrangements.

The first arrangement is as follows: A color forming layer comprising diazonium compounds and coloring assistant are coated on the substrate and, at least two kinds of heat-meltable microcapsule containing coupling component are coated as a homogeneous mixture thereon. The heat-meltable microcapsule has a capsule wall including an infrared absorbent. The capsule wall is double capsule walls comprising an inner and outer capsule wall. The inner capsule wall is composed of porous membrane. The outer capsule wall is composed of porous membrane or heat-meltable substance. The infrared absorbent is contained either in the porous membrane or heat-meltable substance. The infrared absorbent to be used in the present invention includes a substance which absorbs an infrared ray of specified wavelength for causing coloring reaction but which substantially does not absorb an infrared ray of different wavelength for causing another coloring reaction. That is, the coupling component reacts with the diazonium compound to produce the color by absorbing the infrared ray of specified wavelength. The imaging material according to the present invention enables the production of multicolor images at high speed in a simple process.

The second arrangement is as follows: A photosensitive layer comprising a plurality of heat-meltable microcapsules, i.e., a microcapsule layer, are coated on the substrate. The heat-meltable microcapsule has a capsule wall including an infrared absorbent as described above. The heat-meltable microcapsule contains a coupling component, a diazo compound and a coloring assistant as core material.

Hereafter the present invention will be described with reference to the drawings.

Figure 1:
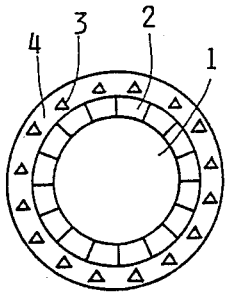
FIG. 1 illustrates a first embodiment of a microcapsule according to the present invention.
Figure 2:
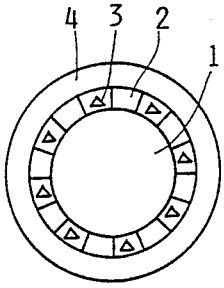
FIG. 2 illustrates a second embodiment of a microcapsule according to the present invention.
Figure 3:
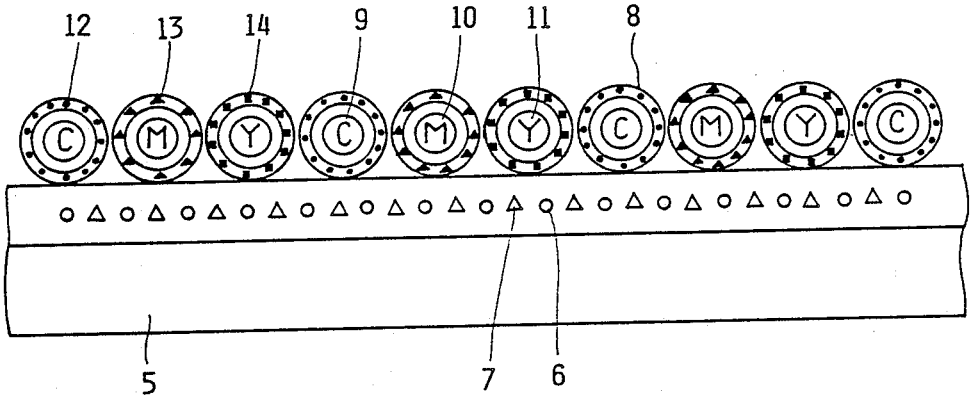
FIG. 3 shows an example of constructing a multicolor imaging material of the present invention using the microcapsules shown in FIG. 1 or FIG. 2.

FIG. 1 illustrates an example of microcapsule according to the present invention. The microcapsule contains a coupling component 1 as core material, an infrared absorbent 3 and a heat-meltable substance 4. The heat-meltable microcapsule has double capsule walls comprising a porous membrane 2 as an inner capsule wall and the heat-meltable substance 4 as an outer capsule wall. The outer capsule wall may be a porous membrane. FIG. 2 shows a heat-meltable microcapsule which has an inner capsule wall formed by a porous membrane 2 including an infrared absorbent 3. In FIG. 2, the inner capsule wall 2 is enwrapped with a porous membrane or a heat-meltable substance. FIG. 3 shows an example of constructing a multicolor imaging material of the present invention using the microcapsules shown in FIG. 1. In FIG. 3, a color forming layer comprising diazonium compounds 6 and coloring assistant 7 are coated on substrate 5 and, three kinds of microcapsules 8 containing cyan coupling component 9, magenta coupling component 10 and yellow coupling component 11 are coated as a homogeneous mixture thereon. The microcapsules of cyan, the microcapsules of magenta and the microcapsules of yellow contain infrared absorbent 12 absorbing a wavelength of $\lambda_1$, infrared absorbent 13 absorbing a wavelength of $\lambda_2$ and infrared absorbent 14 absorbing a wavelength of $\lambda_3$, respectively, at the respective outer capsule walls thereof.

Figure 4:
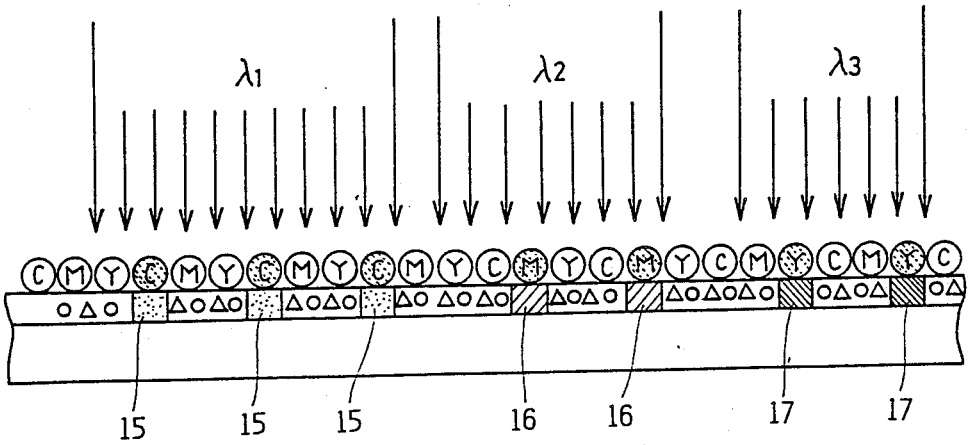
FIG. 4(*a*) and FIG. 4(*b*) show a sketch of an example of a multicolor recording using the multicolor imaging material shown in FIG. 3.
Figure 4B:
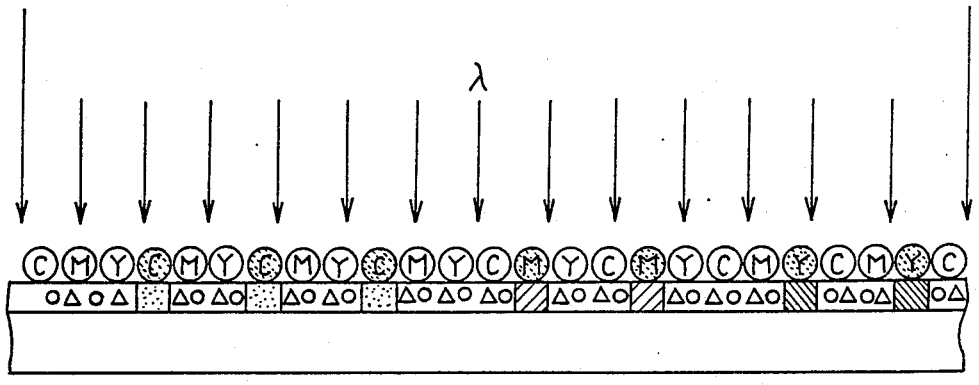

FIG. 4(*a*) and FIG. 4(*b*) show an example of a multicolor recording using the multicolor imaging material shown in FIG. 3. As shown in FIG. 4(*a*), upon exposure to infrared rays having wavelengths of $\lambda_1$, $\lambda_2$ and $\lambda_3$ in response to signals of the three primary colors from a CRT, etc., the microcapsules of cyan, magenta and yellow are heated, whereby the coupling components contained in the respective microcapsules are reacted with the diazonium compounds and the coloring assistant, and cyan color portion 15, magenta color portion 16 and yellow color portion 17 are thus recorded. Next, upon exposure of the entire surface to ultraviolet rays as shown in FIG. 4(*b*), the diazonium compounds at the portion where no color is formed are decomposed to lose their color forming function, whereby multicolor images are fixed and recorded. In other words, when the infrared rays having wavelengths of $\lambda_1$, $\lambda_2$ and $\lambda_3$ are applied to the imaging material according to the signals corresponding to three primary colors, e.g., from a CRT, the heat-meltable microcapsules for individual colors independently generate heat, thereby causing the heatmeltable substance to be melted. This brings about the reaction of the coupling component for individual colors with the diazonium compound and the coloring assistant to develop colors, thereby forming a color image comprised of cyan, magenta, and yellow. Three primary colors, i.e., red, green and blue component images translate into infrared rays having wavelength of $\lambda_2$, and $\lambda_3$, infrared rays having wavelength of $\lambda_1$ and $\lambda_3$ and infrared rays having wavelength of $\lambda_1$ and $\lambda_2$, respectively.

In the multicolor imaging material according to the present invention, at least either the diazonium compound or the coupling component and coloring assistant is microencapsulated. It is preferable to microencapsulate only the coupling component and arrange the color forming layer comprising the diazonium compound and the coloring assistant under the microcapsule layer.

As methods for producing the microcapsules of the present invention, there can be employed known microencapsulation and surface modification, for example, a coacervation method (a phase separation method from an aqueous solution) such as disclosed in U.S. Pat. Nos. 2,800,457 and 2,800,458, an interfacial polymerization method, an in situ method by monomer polymerization, spray drying proposed in U.S. Pat. No. 3,111,407, inorganic wall microencapsulation and a fusion-dispersion-cooling method such as disclosed in British Pat. No. 952807. Other suitable methods may be optionally employed. In particular, interface polymerization, in situ polymerization, etc. are preferred as the method for forming the porous membrane. An example of the method for producing double wall microcapsules includes a method which comprises microencapsulating an organic solvent containing coupling components by interface polymerization, then mixing the microcapsules with a synthetic resin emulsion containing the infrared absorbents to make capsule slurry and then spray drying the slurry to effect double-wall microencapsulation.

Examples of the substances which construct the microcapsules in the present invention include polyamide, polyester, polyurea, polyurethane, urea-formaldehyde resin, melamine resin, etc. as the porous membrane and as the heatmeltable substance, resins having a low melting point such as ethylene-acrylate copolymers, butadiene-styrene copolymers, polyvinyl acetate, etc.

Examples of the infrared absorbents in the present invention include organic compounds such as cyanine dyes, diamine type metal complexes, dithiol type metal complexes, etc. and inorganic compounds such as zinc silicate, magnesium silicate, barium sulfate, barium carbonate, etc.

Examples of the diazonium compounds which can be used in the present invention include p-diazo-N-ethyl chloride zinc chloride double salt, p-diazo-N,N-dimethylaniline chloride zinc chloride double salt, N-(p-diazophenyl)morpholine chloride zinc chloride double salt, p-diazo-N-ethyl-N-hydroxyethyl-m-toluidine chloride zinc chloride double salt, 4-benzoylamino-2,5-diethoxybenzene diazonium chloride zinc chloride double salt, etc.

Examples of the coupling components include resorcine, phloroglucin, pyrazolone derivatives, β-diketonic acid derivatives, oxydiphenyl derivatives, α-naphthol, β-naphthol, phenol, etc.

The diazo compounds and the coupling components which form a dye by coupling with the diazonium compound (that is, the diazonium salt), for use in the present invention are disclosed in the specification of U.S. Pat. Nos. 4,497,887 and 4,665,411. The coloring assistant such as a basic substance which is slightly soluble or which is insoluble in water, or a material capable of producing an alkali by heating, is used and is disclosed in the above specifications.

Examples of the basic substances include guanidine derivatives, hydrazine derivatives, diamine derivatives, pyrazole derivatives, indole derivatives, pyrimidine derivatives, pyrolederivatives, etc.

Examples of the organic solvent which can dissolve the coupling agents of the present invention include alkylated naphthalenes, alkylated biphenyls, alkylated terphenlys, chlorinated paraffins, etc.

As the substrate used in the present invention, there are paper, synthetic paper, synthetic resin films, etc.

The multicolor imaging material of the present invention can be coated onto the substrate using a binder.

Examples of the binder include polyvinyl alcohol, methyl cellulose, carboxymethyl cellulose, styrene-butadiene latex, etc.

For coating the multicolor imaging material of the present invention, there can be employed a bar coater, a roll coater, a blade coater, an air knife coater, etc.

As infrared rays for recording in accordance with the present invention, there can be employed a solid laser such as YAG laser, etc.; a gas laser such as a carbon dioxide laser, etc.; an infrared laser such as a semi-conductor laser, etc.

Hereafter the present invention will be described referring to the examples below but is not deemed to be limited thereto.

EXAMPLE 1

(Microcapsules A)

To 45 parts by weight of diisopropylnaphthalene having dissolved therein 5 parts by weight of terephthalic acid dichloride were added 2 parts by weight of sodium 2,3-dihydroxynaphthalene-6-sulfonate to dissolve. The sodium 2,3-dihydroxynaphthalene-6-sulfonate solution was mixed with an aqueous solution of 3 parts by weight of polyvinyl alcohol in 97 parts by weight of water and the mixture was emulsified and dispersed with a homogenizer to give a dispersion having a mean particle diameter of 10μ. An aqueous solution of 3 parts by weight of diethylene triamine and 3 parts by weight of sodium carbonate in 24 parts by weight of water was added to the dispersion. The mixture was allowed to stand for 24 hours while stirring to give a capsule solution containg sodium 2,3-dihydroxynaphthalene-6-sulfonate as a core material.

Next, the microcapsules were collected by filtration and, 50 parts by weight of the microcapsules were mixed with 50 parts by weight of barium sulfate, 10 parts by weight of styrene-butadiene latex and 150 parts by weight of water. The mixture was stirred to give a capsule slurry. The capsule slurry was subjected to spray drying using a spray drier for experimental use under conditions of an inlet temperature at 130° C., an outlet temperature at 80° C., a pressure of 3.0 kg/cm$^2$ and a solution feed rate of 7 ml/min to give Microcapsules A containing barium sulfate in the capsule wall and sodium 2,3-dihydroxynaphthalene-6-sulfonate as the core material.

(Microcapsules B)

To 45 parts by weight of diisopropylnaphthalene having dissolved therein 5 parts by weight of terephthalic acid dichloride were added 2 parts by weight of 1,3,5-hydroxybenzene to dissolve. The 1,3,5-hydroxybenzene solution was mixed with an aqueous solution of 3 parts by weight of polyvinyl alcohol in 97 parts by weight of water and the mixture was emulsified and dispersed with a homogenizer to give a dispersion having a mean particle diameter of 10μ. An aqueous solution of 3 parts by weight of diethylene triamine and 3 parts by weight of sodium carbonate in 24 parts by weight of water was added to the dispersion. The mixture was allowed to stand for 24 hours while stirring to give a capsule solution contating 1,3,5-hydroxybenzene as a core material.

Next, the microcapsules were collected by filtration and, 50 parts by weight of the microcapsules were mixed with 50 parts by weight of magnesium silicate, 10 parts by weight of styrene-butadiene latex and 150 parts by weight of water. The mixture was stirred to give a capsule slurry. The capsule slurry was subjected to spray drying using a spray drier for experimental use under conditions of an inlet temperature at 130° C., an outlet temperature at 80° C., a pressure of 3.0 kg/cm$^2$ and a solution feed rate of 7 ml/min to give Microcapsules A containing magnesium silicate in the capsule wall and 1,3,5-hydroxybenzene as the core material.

(Microcapsules C)

To 45 parts by weight of diisopropylnaphthalene having dissolved therein 5 parts by weight of terephthalic acid dichloride were added 2 parts by weight of 1-acetoacetonaphthalide to dissolve. The 1-acetoacetonaphthalide solution was mixed with an aqueous solution of 3 parts by weight of polyvinyl alcohol in 97 parts by weight of water and the mixture was emulsified and dispersed with a homogenizer to give a dispersion having a mean particle diameter of 10μ. An aqueous solution of 3 parts by weight of diethylene triamine and 3 parts by weight of sodium carbonate in 24 parts by weight of water was added to the dispersion. The mixture was allowed to stand for 24 hours while stirring to give a capsule solution containing 1-acetoacetonaphthalide as a core material.

Next, the microcapsules were collected by filtration and, 50 parts by weight of the microcapsules were mixed with 50 parts by weight of zinc silicate, 10 parts by weight of styrene-butadiene latex and 150 parts by weight of water. The mixture was stirred to give a capsule slurry. The capsule slurry was subjected to spray drying using a spray drier for experimental use under conditions of an inlet temperature at 130° C., an outlet temperature at 80° C., a pressure of 3.0 kg/cm$^2$ and a solution feed rate of 7 ml/min to give Microcapsules A containing zinc silicate in the capsule wall and 1-acetoacetonaphthalide as the core material.

(Dispersion A)

To 100 parts by weight of 5% polyvinyl alcohol aqueous sopution were added 20 parts by weight of 4-chloro-2-trifluoromethylaniline. The mixture was dispersed for 24 hours in a ball mill to give Dispersion A of 4-chloro-2-trifluoromethylaniline.

(Dispersion B)

To 100 parts by weight of 5% polyvinyl alcohol aqueous solution were added 20 parts by weight of 2-p-tolyl-1,3-diphenyl-guanidine. The mixture was dispersed for 24 hours in a ball mill to give Dispersion B of 2-p-tolyl-1,3-diphenylguanidine.

To a mixture of 20 parts by weight of Dispersion A and 20 parts by weight of Dispersion B were added 20 parts by weight of Microcapsules A and 20 parts by weight of Microcapsules B thus obtained. The mixture was mixed and made a coating solution. The coating solution was coated onto wood free paper of 50 g/m$^2$ in an amount of 20 g/m$^2$ (dry weight) using a wire bar, which was dried to give a multicolor imaging material.

Recording was made on the multicolor imaging material at an output of 1.0 W and a scanning rate of 2 m/sec using a carbon dioxide laser having a wavelength of 9.2$\mu$ to give color images having a clear cyan color. Next, a recording was made at an output of 1.0 W and a scanning rate of 2 m/sec using a carbon dioxide laser having a wavelength of 9.6$\mu$ to give color images having a clear magenta color. The cyan and magenta color images showed no color contamination at all. Further, after the color formation, ultraviolet rays were irradiated to perform fixing and as the result, a fog density was hardly changed even one week after.

EXAMPLE 2

A multicolor imaging material was obtained in a manner similar to Example 1 except that Microcapsules C were used in place of Microcapsules B.

Recording was made on the multicolor imaging material under the same conditions as in Example 1 using a carbon dioxide laser having a wavelength of 10.6$\mu$ and then using a carbon dioxide laser having a wavelength of 9.6$\mu$ to give color images having clear cyan and yellow colors. The cyan and yellow color images showed no color contamination at all. Further, after the color formation, ultraviolet rays were irradiated to perform fixing and as the result, a fog density was hardly changed even one week after.

EXAMPLE 3

A multicolor imaging material was obtained in a manner similar to Example 1 except that Microcapsules C were used in place of Microcapsules A.

Recording was made on the multicolor imaging material under the same conditions as in Example 1 using a carbon dioxide laser having a wavelength of 9.6$\mu$ and then using a carbon dioxide laser having a wavelength of 10.6$\mu$ to give color images having clear magenta and yellow colors. The magenta and yellow color images showed no color contamination at all. Further, after the color formation, ultraviolet rays were irradiated to perform fixing and as the result, a fog density was hardly changed even one week after.

EXAMPLE 4

To a mixture of 30 parts by weight of dispersion A and 30 parts by weight of Dispersion B were added 20 parts by weight of Microcapsules A, 20 parts by weight of Microcapsules B and 20 parts by weight of Microcapsules C in Example 1. The mixture was mixed and made a coating solution. The coating solution was coated onto wood free paper of 50 g/m$^2$ in an amout of 20 g/m$^2$ (dry weight) using a wire bar, which was dried to give a multicolor imaging material.

Recording was made on the multicolor imaging material under the same conditions as in Example 1 using carbon dioxide lasers having wavelengths of 9.2$\mu$, 9.6$\mu$ and 10.6$\mu$ to give color images having clear cyan, magenta and yellow colors. The cyan, magenta and yellow color images showed no color contamination at all. Further, after the color formation, ultraviolet rays were irradiated to perform fixing and as the result, a fog density was hardly changed even one week after.

EXAMPLE 5

Figure 5:
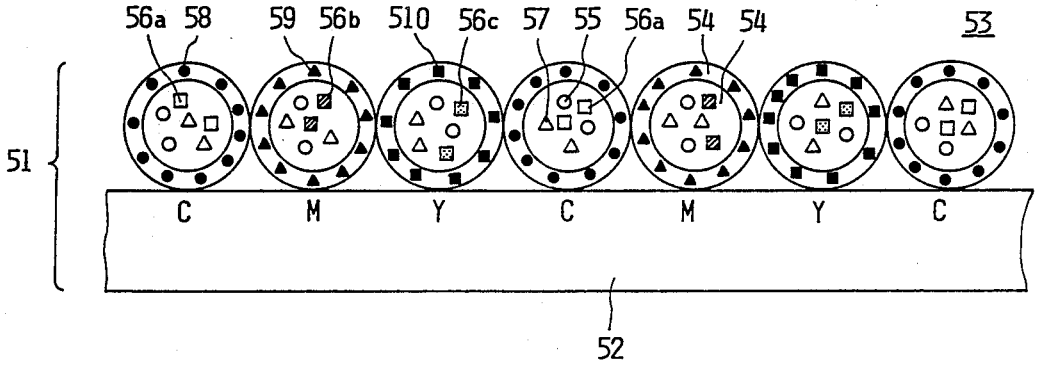
FIG. 5 illustrates another example of constructing a multicolor imaging material of the present invention.

Another arrangement of the present invention will be described as follows. FIG. 5 is a schematic view of multicolor imaging material of the arrangement. In FIG. 5, an imaging material 51 comprises a substrate 52 coated on a capsule layer made up of microcapsules 53. The capsule layer comprises three kinds of microcapsules respectively containing core materials comprised of a combination of either one of cyan, magenta-, and yellow- coupling components 56*a*, 56*b* and 56*c*, diazonium compound 55 and basic substance 57. The three kinds of microcapsules respectively for cyan, magenta and yellow each have a capsule wall containing infrared absorbents 58, 59 and 510. The core materials of microcapsule which comprises the coupling component, diazonium compound and basic substance are dispersed in a heat-meltable substance 54. Upon exposure to infrared rays having wavelengths of $\lambda_1$, $\lambda_2$ and $\lambda_3$ in response to signals of the three primary colors a CRT, etc., the microcapsules of cyan, magenta and yellow are heated correspondingly by the respective wavelengths, whereby the coupling component contained in the respective microcapsules react with the diazonium compound 55 and the basic substance 57 and cyan color portion, magenta color portion and yellow color portion are recorded. Moreover the unreacted diazonium compound thereof is decomposed by subjecting to overall exposure by ultraviolet rays whereby multicolor images are fixed.

As descrobed above, the imaging material according to the present invention can be used as printer paper. Moreover, the imaging material of the diazo type prevents undesired color-formation after image forming so that irradiation is performed so as to decompose unreacted diazonium compound to stop the color forming.

What is claimed is:

1. A multicolor imaging material comprising:

a substrate; and a photosensitive layer on the substrate containing a diazo compound, a coupling component, a coloring assistant and an infrared absorbent, said coupling component being encapsulated with a heat-meltable microcapsule such that the coupling component is released from the microcapsule to react with the diazo compound to thereby produce the color, said heat-meltable microcapsule having a porous membrane which encloses the coupling component and a capsule wall which includes the infrared absorbent effective to absorb infrared rays of a specified wavelength to generate heat to thereby melt the capsule wall of the microcapsule to release the coupling component through the porous membrane.

2. A multicolor imaging material as claimed in claim 1, wherein the capsule wall is a double capsule wall which comprises an inner and outer capsule wall, the inner capsule wall being formed of the porous membrane.

3. A multicolor imaging material as claimed in claim 1, wherein there are at least two different kinds of capsules which respectively contain different coupling components which are adapted to react with the diazo compound to form different colors, the at least two different kinds of capsules respectively absorbing different infrared absorbents.

4. A multicolor imaging material as claimed in claim 1, wherein the outer capsule wall is composed of either a heat-meltable substance or a porous membrane.

5. A multicolor imaging material as claimed in claim 1, wherein the photosensitive layer comprises a color forming layer and a layer of the heat-meltable microcapsules, the color forming layer, which contains the diazo compound and coloring assistant, being formed on the substrate.

6. A multicolor imaging material as claimed in claim 1, wherein the microcapsules comprise first capsules which contain a cyan coupling component and an infrared absorbent for absorbing light of a first wavelength ($\lambda_1$), second capsules which contain a magenta coupling component and an infrared absorbent for absorbing light of a second wavelength ($\lambda_2$), third capsules which contain a yellow coupling component and an infrared absorbent for absorbing light of a third wavelength ($\lambda_3$), each infrared absorbent absorbing light substantially only of its respective wavelength ($\lambda_1$, $\lambda_2$, $\lambda_3$).

7. A multicolor imaging material comprising:

a substrate;

a capsule layer composed of microcapsules each having a porous membrane and a capsule wall, the individual microcapsules containing an infrared absorbent effective to absorb an infrared ray of specified wavelength to generate heat to thereby melt the capsule wall of the microcapsules, and a coupling component releasable from the microcapsules by permeating through the porous membrane; and a color forming layer composed of a diazonium compound and coloring assistant, said color forming layer being formed between the substrate and the capsule layer.

8. A multicolor imaging material, comprising:

a substrate; and a photosensitive layer on the substrate comprising a diazo compound, a coloring assistant and means defining microcapsules encapsulating a coupling component, each of the microcapsules comprising a porous membrane enclosing the coupling component and a heat-meltable capsule wall including an infrared absorbent effective to absorb infrared rays of a preselected wavelength radiated thereto to generate heat to thereby melt the microcapsule wall to release the coupling component through the porous membrane to react with the diazo compound to produce a color corresponding to the preselected wavelength.

9. A multicolor imaging material as claimed in claim 8, wherein the microcapsule wall comprises a double capsule wall including an inner and outer capsule wall, the inner capsule wall comprises of the porous membrane.

10. A multicolor imaging material as claimed in claim 8, comprising at least two different kinds of microcapsules which encapsulate different coupling components which react with the diazo compound to form different colors, the at least two different kinds of microcapsules comprising different infrared absorbents.

11. A multicolor imaging material as claimed in claim 8, wherein the microcapsule wall comprises one of a heat-meltable substance and a porous membrane.

12. A multicolor imaging material as claimed in claim 8, wherein the photosensitive layer comprises a color forming layer and a layer of the heat-meltable microcapsules, wherein the color forming layer includes the diazo compound and coloring assistant and is disposed on the substrate.

13. A multicolor imaging material as claimed in claim 8, wherein the microcapsules comprise first capsules which contain a cyan coupling component and an infrared absorbent for absorbing light of a first wavelength ($\lambda_1$), second microcapsules which contain a magenta coupling component and an infrared absorbent for absorbing light of a second wavelength ($\lambda_2$) different from the first wavelength, third capsules which contain a yellow coupling component and an infrared absorbent for absorbing light of a third wavelength ($\lambda_3$) different from the first and second wavelengths, each infrared absorbent absorbing light substantially only of its respective first, second and third wavelength ($\lambda_1$, $\lambda_2$, $\lambda_3$).

14. A multicolor imaging material as claimed in claim 12, wherein the color forming layer is disposed between the substrate and the microcapsule layer.

* * * * *